US005201852A

United States Patent [19]

Ogoshi

[11] Patent Number: 5,201,852

[45] Date of Patent: Apr. 13, 1993

[54] FIXING DEVICE

[75] Inventor: Toshihide Ogoshi, Yamatokoriyama, Japan

[73] Assignee: Sharp Kabushiki Kaisha, Osaka, Japan

[21] Appl. No.: 885,725

[22] Filed: May 19, 1992

[30] Foreign Application Priority Data

May 20, 1991 [JP] Japan ..... 3-115008

[51] Int. Cl.[5] ..... G03G 15/20

[52] U.S. Cl. ..... 432/60; 355/200; 355/283; 15/256.52

[58] Field of Search ..... 355/283, 282, 285, 290, 355/295, 200; 219/216; 432/60; 15/256.52

[56] References Cited

U.S. PATENT DOCUMENTS 3,649,992 3/1972 Thettu ..... 15/256.52
3,861,860 1/1975 Thettu et al. ..... 15/256.52 X
3,937,919 2/1976 Clerx et al. ..... 219/216
3,980,424 9/1976 Latone ..... 15/256.52 X
4,018,555 4/1977 Thettu ..... 15/256.52 X
4,231,653 11/1980 Nagahara et al. .
4,579,802 4/1986 Kishi et al. ..... 430/99
4,607,949 8/1986 Ensing et al. ..... 15/256.52 X
4,711,549 12/1987 Roodbeen .
4,736,226 4/1988 Mogi .
4,782,359 11/1988 Tomoe ..... 432/60
4,899,197 2/1990 Davis et al. ..... 355/283 X

FOREIGN PATENT DOCUMENTS 1-206382 8/1989 Japan .

*Primary Examiner*—Richard L. Moses
*Attorney, Agent, or Firm*—David G. Conlin; Peter F. Corless

[57] ABSTRACT

A fixing device is provided, which comprises a heating roller rotatably supported by front and rear frames of a fixing device body; a cleaning roller pressed against the heating roller; an insertion opening which is formed on the front frame of the fixing device body and through which the cleaning roller is inserted and pulled out in an axial direction; a front side supporter which rotatably supports a front side end of a rotation axis of the cleaning roller so that the front side end is moved in an axial direction to be detached from the front side supporter and which biases the front side end toward the heating roller; and a rear side supporter which rotatably supports a rear side end of the rotation axis of the cleaning roller so that the rear side end is moved in an axial direction so as to be detached from the rear side supporter and which biases the rear side end toward the heating roller.

3 Claims, 7 Drawing Sheets

FIXING DEVICE

BACKGROUND OF THE INVENTION

1. Field of the Invention

The present invention relates to a fixing device used for a printing machine for issuing airline tickets, a general copying machine, a laser printer or the like.

2. Description of the Prior Art

In general, as shown in FIG. 8, this kind of fixing device comprises a heating roller 2 in a fixing device body 1, a pressure roller 3 for pressing a sheet from underneath the heating roller 2, and a cleaning roller 4 being in contact with the upper face of the heating roller 2 on the sheet discharge side thereof. The lifetime of the cleaning roller 4 is known to be about one-sixth of that of the other portions of the fixing device. Thus, it is necessary to exchange the cleaning roller 4 more frequently than the other portions.

When the conventional cleaning roller 4 is installed or exchanged, a plate 5 supporting the cleaning roller 4 with respect to the fixing device body 1 has to be installed or exchanged together. According to this method, when the cleaning roller 4 is exchanged, first, a screw or the like for fixing the plate 5 is removed from the fixing unit, and the cleaning roller 4 is exchanged together with the plate 5.

In addition, there is another method for installing or exchanging the cleaning roller 4, in which a fixing screw in a bearing which fixes the cleaning roller 4 is removed.

However, with any conventional method, it is required to use tools for removing screws or the like, and to take out the whole fixing unit because of the removal of the screws, resulting in complicated works and a great amount of labor. Accordingly, users cannot readily exchange the cleaning roller despite a need for a high frequency of exchange. Moreover, the hands of the users are likely to get dirty due to the complicated works.

SUMMARY OF THE INVENTION

The fixing device of this invention, comprises:

a heating roller rotatably supported by front and rear frames of a fixing device body;

a cleaning roller pressed against the heating roller;

an insertion opening which is formed on the front frame of the fixing device body and through which the cleaning roller is inserted and pulled out in an axial direction;

a front side supporting means which rotatably supports a front side end of a rotation axis of the cleaning roller so that the front side end is moved in an axial direction to be detached from the front side supporting means and which biases the front side end toward the heating roller; and a rear side supporting means which rotatably supports a rear side end of the rotation axis of the cleaning roller so that the rear side end is moved in an axial direction to be detached from the rear side supporting means and which biases the rear side end toward the heating roller.

In a preferred embodiment, the front side supporting means is made detachable from an opposite side of the heating roller with respect to the rotation axis of the cleaning roller, rotatably supports the rotation axis, and includes a supporting chip which projects beyond the font frame and a spring which biases the supporting chip toward the heating roller.

In another preferred embodiment, the rear side supporting means includes a bearing which supports the rear side end of the rotation axis of the cleaning roller so that the rear side end is moved in an axial direction so as to be detached from the bearing; a notch which is provided in the rear frame of a fixing device so that the bearing is slidably supported toward the heating roller; and a spring which biases the bearing in the notch toward the heating roller with the same biasing force of that of the front side supporting means.

Thus, the invention described herein makes possible the objective of providing a fixing device in which a cleaning roller can be readily exchanged without using any tools.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENT

Hereinafter, the present invention will be described by way of an illustrative example with reference to the drawings.

EXAMPLE

Figure 6:
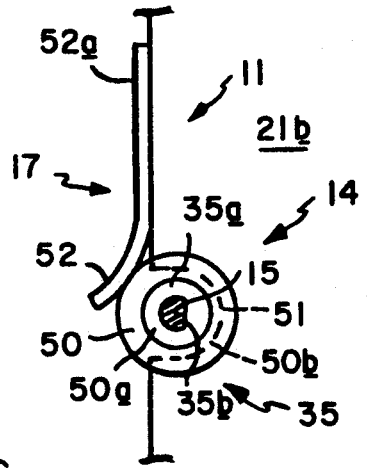
FIG. 6 is a cross-sectional view showing a rear side supporting means of the fixing device according to the present invention.
Figure 7:
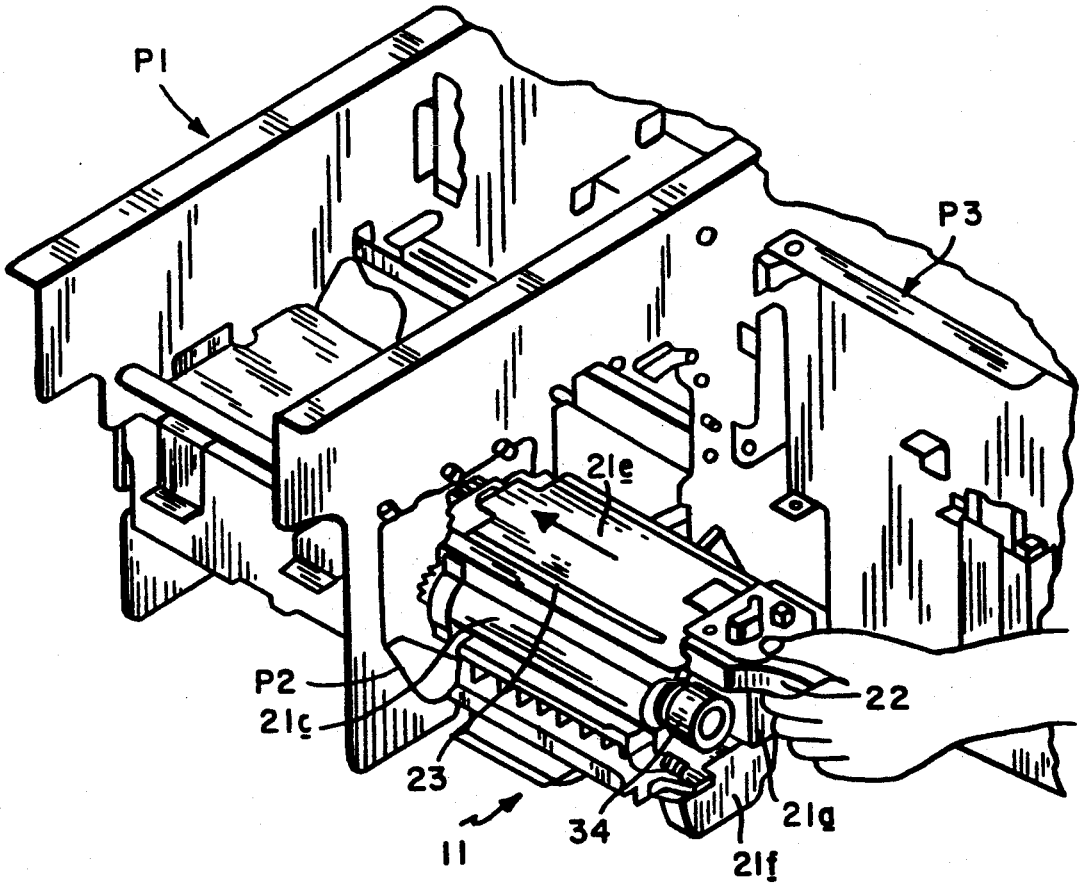
FIG. 7 is a perspective view in the case where the fixing device according to the present invention is applied to a printing machine for issuing airline tickets.
Figure 8:
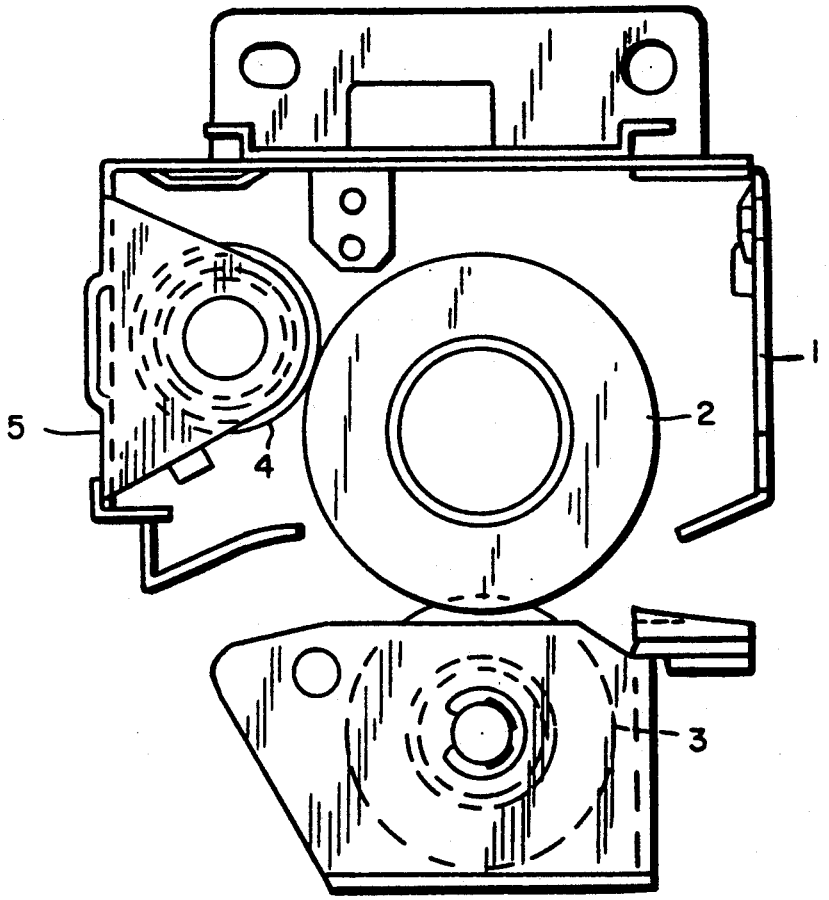
FIG. 8 PRIOR ART
FIG. 8 is a cross-sectional view showing a conventional fixing device.

A fixing device of the present example is used as a constituent of a printing machine for printing flight Nos., dates, seat Nos., and the like. A toner image is fixed onto a sheet by melting, whereby this image is printed on an airline ticket. As shown in FIG. 7, the fixing device is installed detachably from a front face opening P2 of a printing machine body P1. In the fixing device, as shown in FIGS. 1 to 7, a heating roller 12 is rotatably supported by front and rear frames 21*a* and 21*b* of a fixing device body 11. A cleaning roller 14 is pressed by the heating roller 12, and an insertion opening 28 is formed on the front frame 21*a* for the purpose of allowing the cleaning roller 14 to be inserted and pulled out in an axial direction. A front side supporting means 16 and a rear side supporting means 17 are provided. The front side supporting means 16 rotatably supports a front side end of a rotation axis 15 of the cleaning roller 14 and biases the front side end toward the heating roller 12. The rear side supporting means 17 biases a bearing 50, which supports a rear side end of the rotation axis 15 of the cleaning roller 14, toward the heating roller 12. The supporting means 16 and 17 are installed so that the rotation axis 15 of the cleaning roller 14 is detachably disposed in an axial direction.

Figure 1:
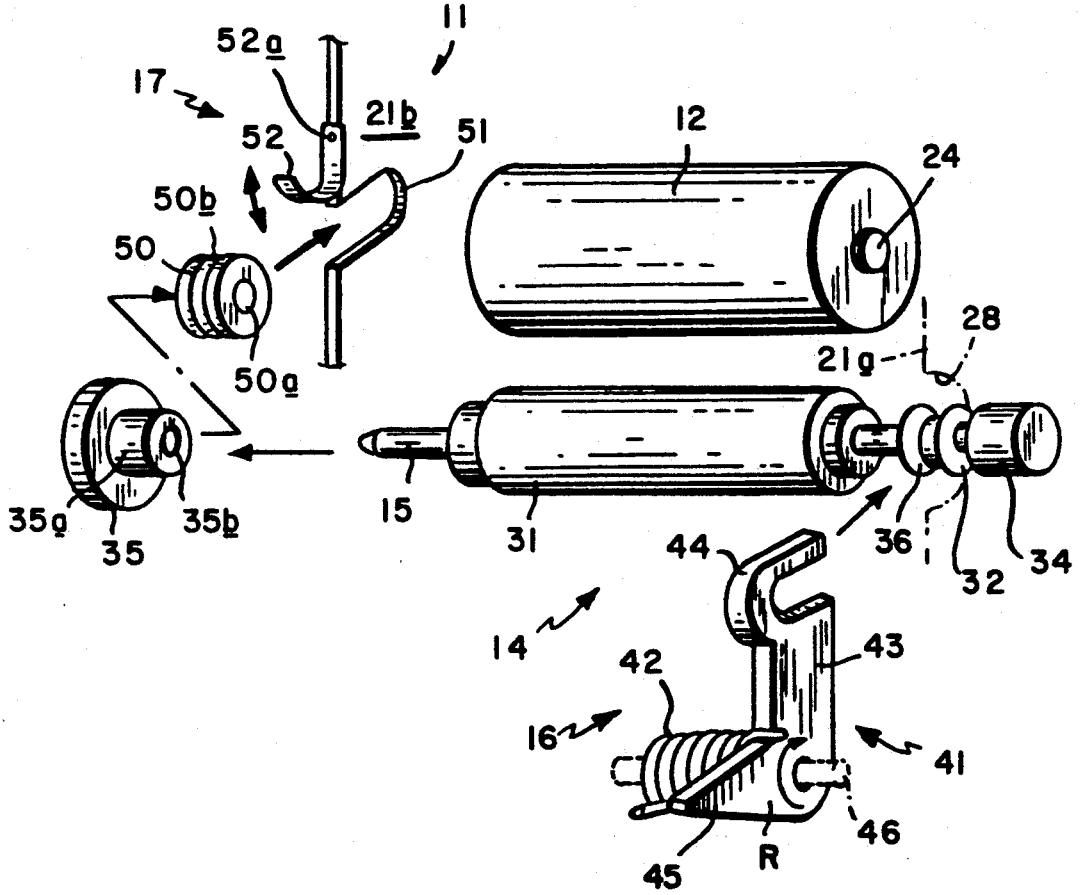
FIG. 1 is a perspective view schematically showing an example of a periphery of a cleaning roller of a fixing device according to the present invention.
Figure 2:
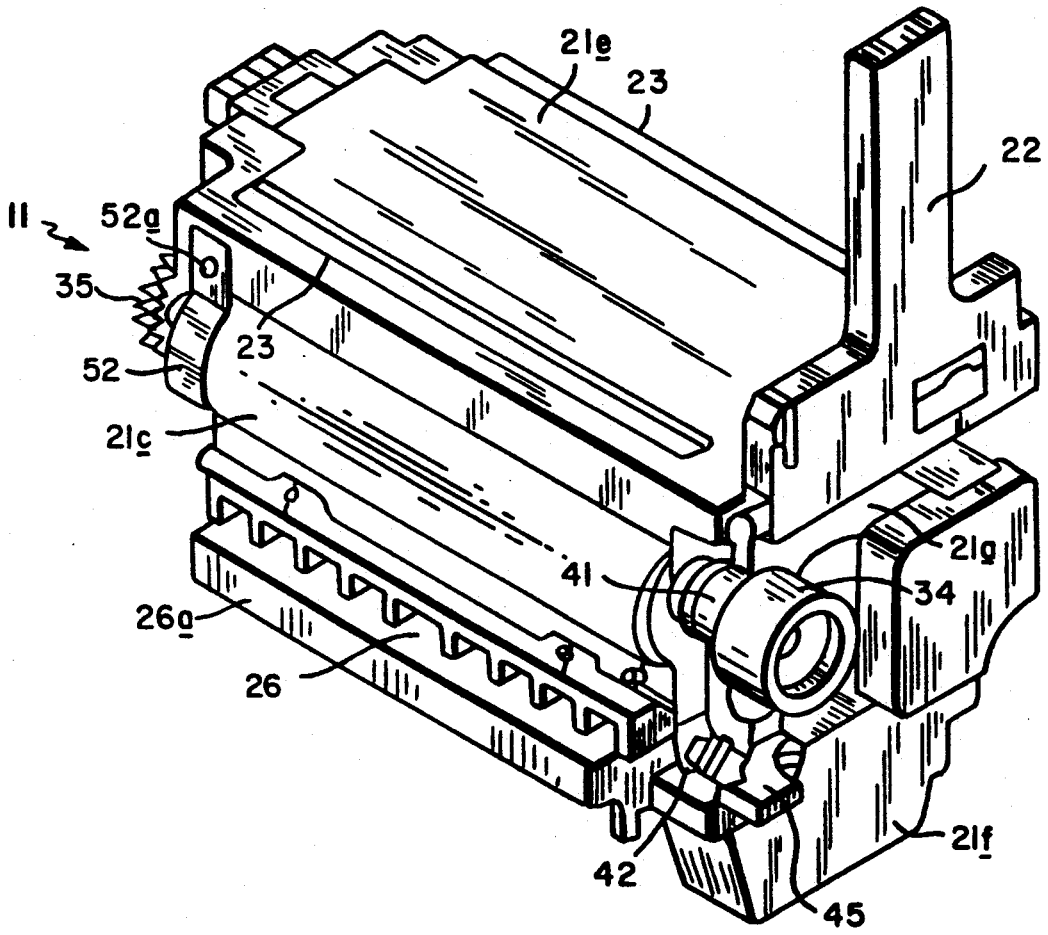
FIG. 2 is a perspective sketch view showing the fixing device according to the present invention.
Figure 3:
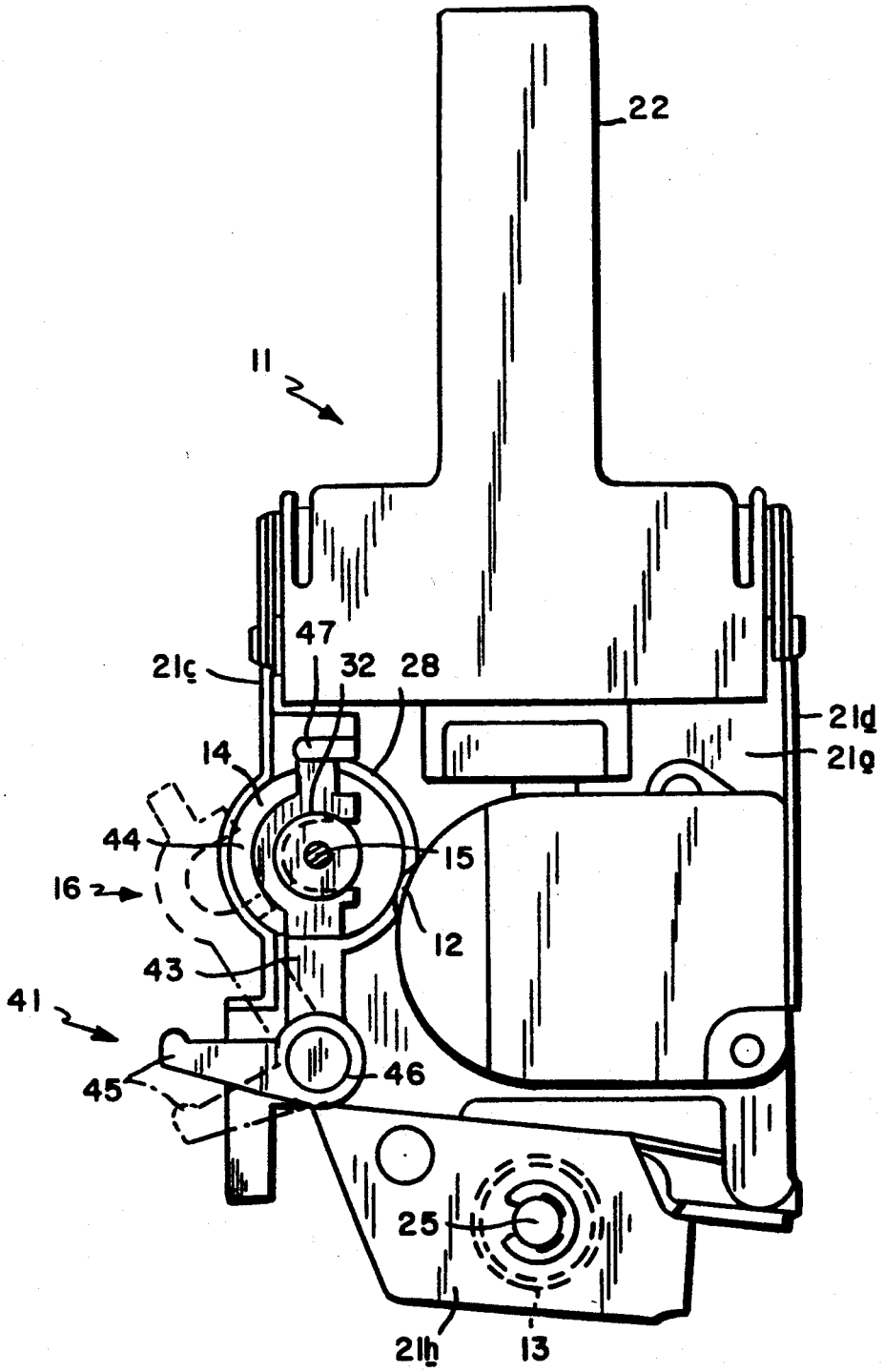
FIG. 3 is a front view showing the fixing device according to the present invention.

As shown in FIGS. 1 to 5, the fixing device body 11 is substantially in a box shape including the front and rear frames 21*a* and 21*b*, side plates 21*c* and 21*d* for closing side faces of an open space between the frames 21*a* and 21*b*, an upper plate 21*e* for closing an upper face of the open space, and a lower face cover 21*f* for closing a lower face of the open space so that it can be opened freely. As shown in FIGS. 2 and 3, a pullout handle 22 is provided in the vicinity of an upper end of the upper plate 21*e*, and projections 23 are formed projecting from both sides of the upper plate 21*e* so as to be engaged with a rail of the printing machine body 11. The heating roller 12 is supported by the front and rear frames 21*a* and 21*b* so that it can rotate around the rotation axis 24 as shown in FIGS. 1 and 3. A pressure roller 13 is supported by a supporting frame 21*h* in the lower face cover 21*f* so that it can rotate around a rotation axis 25.

In FIG. 2, the reference numerals 26 and 26*a* denote a sheet exit for discharging a sheet and a guide for guiding a sheet to the sheet exit 26. In FIG. 3, the reference numeral 28 denotes an insertion opening which is formed in the front frame 21*a* and allows the cleaning roller 14 to be inserted. The diameter of the insertion opening 28 is made slightly larger than the peripheral diameter of the cleaning roller 14.

Figure 4:
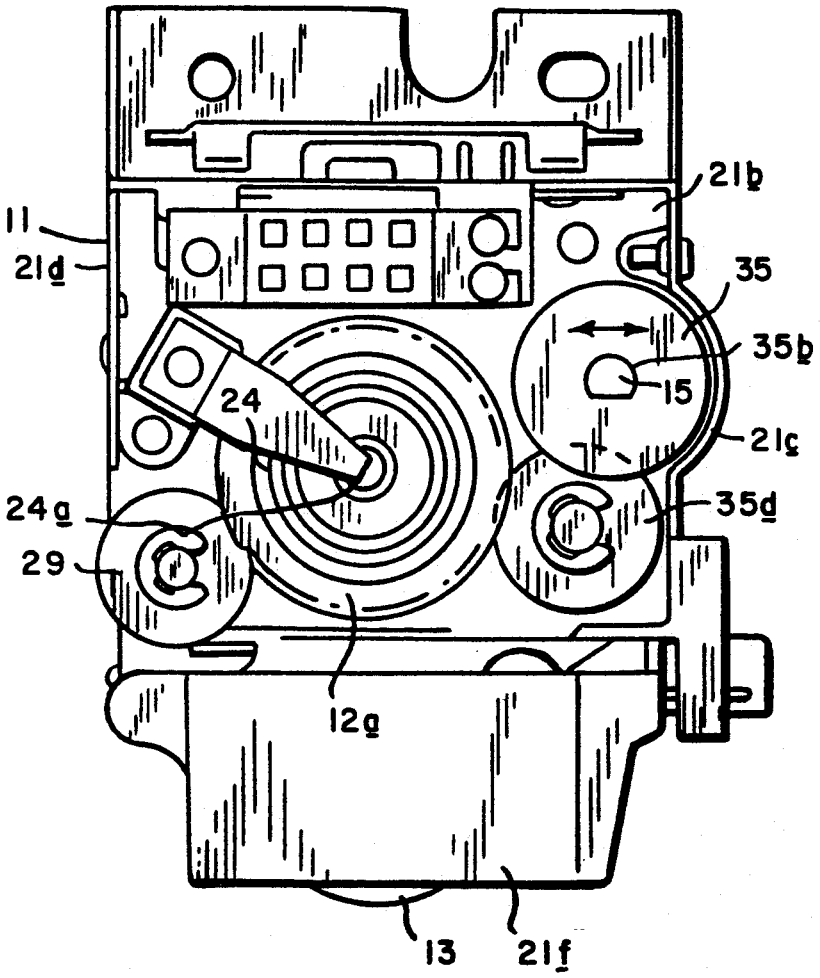
FIG. 4 is a rear view showing the fixing device according to the present invention.

The heating roller 12 directly comes into contact with a sheet surface to which toner has been adhered and allows the toner to be fixed by melting. As shown in FIG. 4, a surface temperature of the heating roller 12 is set at a high temperature by a halogen heat lamp 24*a* and the like. At the rear side end of the rotation axis 24 of the heating roller 12, a gear 12*a* engages a driving gear 29 for transmitting motive power from an external mechanism.

The pressure roller 13 presses a copying sheet against the heating roller 12 from the back side thereof and is provided below the heating roller 12.

As shown in FIG. 1, the cleaning roller 14 absorbs toner adhered to the heating roller 12. The cleaning roller 14 includes the rotation axis 15 and an impression cylinder 31 made of felt which winds around the rotation axis 15 and in which oil is impregnated. On the front side of the rotation axis 15, an engagement ring 32 (front side bearing) is supported by the supporting means 16 so that the rotation axis 15 and the engagement ring 32 are freely rotated, and on the tip end thereof, a knob 34 is fixed. As shown in FIGS. 4 and 6, the rear side end of the rotation axis 15 is formed in a D shape in its cross-section so as to detachably engage a D-shaped hole 35*b* of a boss 35*a* of a gear 35 intruded into a bearing 50 that will be described later. As shown in FIG. 4, the gear 35 is rotated via a transfer gear 35*d*, whereby the cleaning roller 14 rotates in the direction required to rub the surface of the heating roller 12. In FIG. 1, the reference numeral 36 denotes a groove for preventing a positional shift of the cleaning roller 14 in forward and backward directions with respect to the front side supporting means 16.

Figure 5:
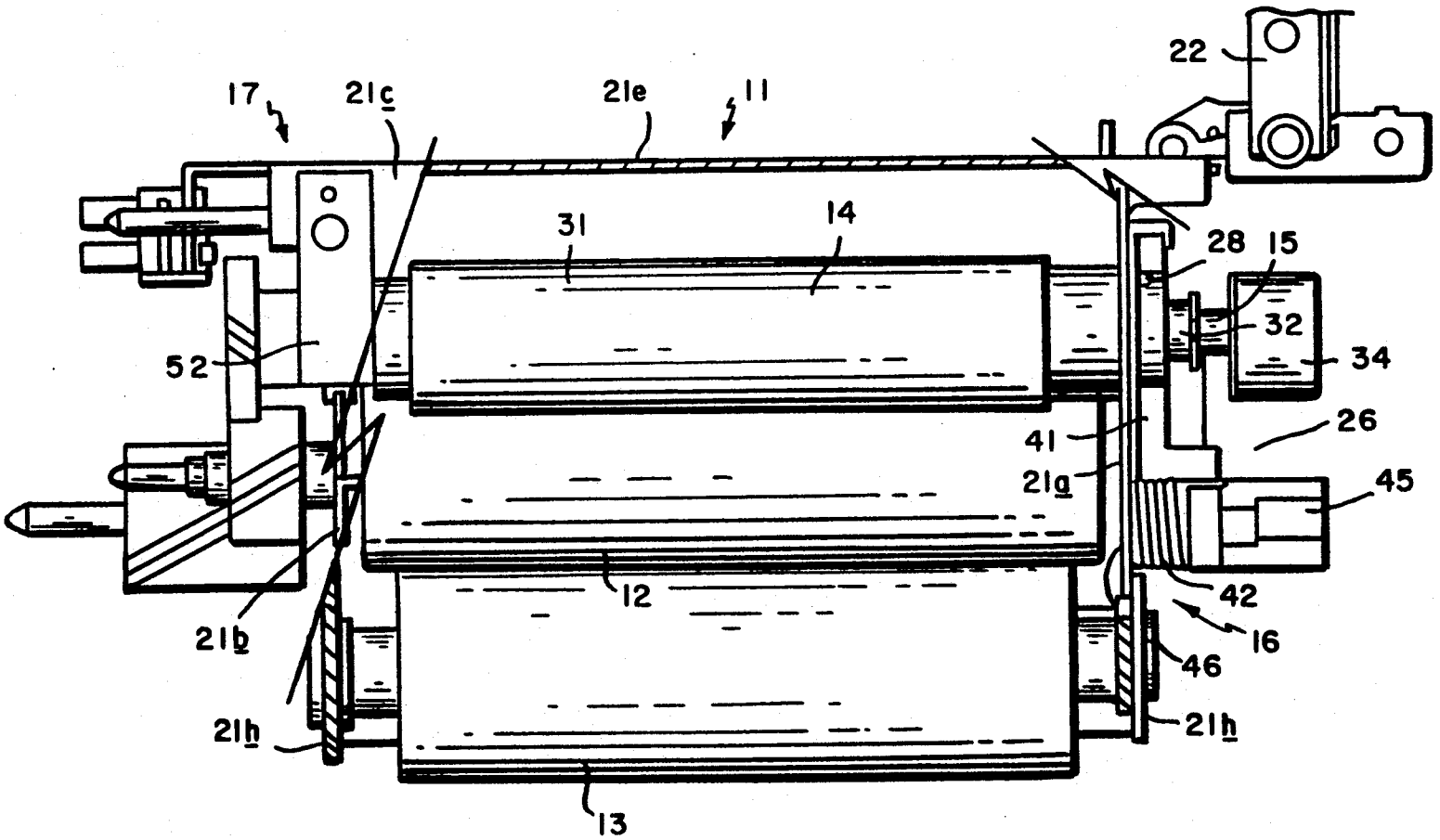
FIG. 5 is a cross-sectional view, partly broken, showing the fixing device according to the present invention.

As shown in FIGS. 1, 3, and 5, the front side supporting means 16 includes a supporting chip 41 for rotatably supporting the engagement ring 32 from the opposite side of the heating roller 12 and a spring 42 for biasing the supporting chip 41 toward the heating roller 12.

As shown in FIGS. 1 and 3, the supporting chip 41 includes a base 43, a supporting portion 44 substantially in a C shape which presses the engagement ring 32 against the heating roller 12 to such a degree that the heating roller 12 can rotate, and a hook lever 45 formed at a lower end of the base 43.

The lower end of the base 43 is supported at a lower end corner of the front frame 21*a* of the fixing device body 11 so that the base 43 can rotate around a horizontal axis 46. Because of this, the supporting portion 44 of the supporting chip 41 is made detachable from the heating roller 12 against the biasing force of the spring 42. As shown in FIG. 3, in order to prevent the excessive rotation of the supporting chip 41 toward the heating roller 12, a stopper 47 is provided.

The hook lever 45 projects beyond the frame 21*a* and is provided so as to be in an orthogonal relationship with the base 43.

The spring 42 winds around the periphery of the horizontal axis 46 of the supporting chip 41. One end thereof is fixed at the base 43 of the supporting chip 41 and the other end thereof is fixed at the fixing device body 11, thereby biasing the supporting chip 41 in an R direction.

As shown in FIG. 1, the rear side supporting means 17 includes the bearing 50, a notch 51 which is formed on the rear frame 21*b* and detachably supports the bearing 50, and a spring 52 for biasing the rotation axis 15 in the notch 51 toward the heating roller 12.

As shown in FIG. 6, an insertion opening 50*a* is formed in a center of the bearing 50, and the boss 35*a* of the gear 35 is rotatably inserted into this insertion opening 50*a*. As shown in FIG. 1, on the peripheral surface of the bearing 50, the groove 50*b* is formed for the purpose of preventing a positional shift of the bearing 50 in forward and backward directions in the case where the bearing 50 is supported by the notch 51.

The notch 51 is formed by notching the end of the rear frame 21*b* substantially in a C shape. The diameter of the notch 51 is set so as to be almost equal to the inner peripheral diameter of the groove 50*b* of the bearing 50. The size of a depth of the notch 51 is set so that the cleaning roller 14 is pressed against the heating roller 12 and the bearing 50 slightly juts out in the case where the bearing 50 is inserted in the notch 51.

As shown in FIGS. 1 and 6, one sheet of a flat spring in a strip shape is used as the spring 52. An upper end of the spring 52 is fixed above the notch 51 of the side plate 21*c* with a pin 52*a*.

In FIG. 7, the reference numeral P3 denotes a closed door of the front face opening P2 of the printing machine body P1.

According to the above-mentioned structure, as shown in FIG. 1, in the course of the assembly of the fixing device, the bearing 50 is previously inserted into the notch 51 and the upper end of the spring 52 is fixed onto the side plate 21*c* with a pin 52*a*. The supporting chip 41 is rotatably provided around the horizontal axis 46 and the spring 42 is wound around the horizontal axis 46. The fixing device body 11 is mounted on the sheet exit side of a photosensitive unit from the front face opening P2 of the printing machine body P1.

Moreover, as shown by a dash-dot line in FIG. 3, when the cleaning roller 14 is mounted, the hook lever 45 of the supporting chip 41 is first rotated downward so that the supporting chip 41 is tilted on the opposite side of the heating roller 12. Then, the cleaning roller 14 is inserted into the insertion opening 28 of the front frame 21*a*, and the rear side end in a D shape of the rotation axis 15 is inserted into the D-shaped hole 35*b* of the gear 35 in the bearing 50.

Next, the engagement ring 32 of the front side end of the rotation axis 15 is engaged with the supporting portion 44 of the supporting chip 41, and the supporting chip 41 is rotated toward the heating roller 12, whereby the installation is completed as shown in FIG. 2.

Thereafter, the fixing device is inserted from the front face opening P2 of the printing machine body Pl and each mechanism is driven, whereby toner adhered to the heating roller 12 is transferred to the surface of the cleaning roller 14.

Herein, in order that the cleaning roller 14 is exchanged without being removed from the printing machine body P1 of the fixing device, it is necessary to pull out the fixing device body 11 forward. However, according to this method, the problem is how the pressure of the cleaning roller 14 is applied to the heating roller 12. In the present example, the pressure is applied to the both sides of the axis of the cleaning roller 14 by the springs 42 and 52. More specifically, since the supporting chip 41 and the bearing 50 are biased by the spring 42 and the spring 52, respectively, the surface of the cleaning roller 14 can be pressed against the heating roller 12 uniformly, whereby cleaning irregularities can be prevented.

In addition, when the consumable cleaning roller 14 is exchanged, as shown in FIG. 3, the hook lever 45 of the supporting chip 41 is rotated downward on the front side of the front frame 21*a* under the condition that the fixing device body 11 is kept in the printing machine body P1, whereby the hook lever 45 is made away from the heating roller 12. The cleaning roller 14 is pulled in an axial direction, whereby it is taken out of the insertion opening 28 of the front frame 21*a*. A new cleaning roller is installed in the above-mentioned procedure.

As described above, since the cleaning roller 14 is detachably mounted in an axial direction with respect to the fixing device body 11, the cleaning roller 14 can be readily exchanged without using any tools. Thus, users can exchange cleaning rollers without a great amount of labor and complicated procedure.

Moreover, the supporting chip 41 projects beyond the front frame 21*a*, so that the cleaning roller 14 can be pulled out in an axial direction by rotating the supporting chip 41 on the front side of the fixing device body 11. Thus, the cleaning roller 14 can be exchanged without being moved, under the same condition that the fixing device body 11 is being used.

The present invention is not limited to the above-mentioned example, and modifications or alterations can be made within the range of the present invention.

According to the above-mentioned example, the present invention is applied to a printing machine for issuing airline tickets. The present invention can also be applied to electro-static process copying machines, laser printers and the like.

As is apparent from the above-mentioned description, the front side supporting means and the rear side supporting means are provided in the fixing device body and the rotation axis of the cleaning roller is detachably mounted in the axial direction, so that the cleaning roller can be readily exchanged without using any tools.

Moreover, since the supporting chip projects beyond the front frame, the cleaning roller can be pulled out in an axial direction by rotating the supporting chip on the front side of the fixing device body and it can be exchanged without being moved, under the same condition that the fixing device body is being used.

Furthermore, since the spring for biasing the bearing toward the heating roller with the same biasing force of that of the front side supporting means. Thus, there is the excellent effect in that the surface of the cleaning roller is uniformly pressed against the heating roller, thereby preventing cleaning irregularities.

Various other modifications will be apparent to and can be readily made by those skilled in the art without departing from the scope and spirit of this invention. Accordingly, it is not intended that the scope of the claims appended hereto be limited to description as set forth herein, but rather that the claims be broadly construed.

What is claimed is:

1. A fixing device comprising:

a heating roller rotatably supported by front and rear frames of a fixing device body;

a cleaning roller pressed against the heating roller;

an insertion opening which is formed on the front frame of the fixing device body and through which the cleaning roller is inserted and pulled out in an axial direction;

a front side supporting means which rotatably supports a front side end of a rotation axis of the cleaning roller so that the front side end is moved in an axial direction to be detached from the front side supporting means and which biases the front side end toward the heating roller; and a rear side supporting means which rotatably supports a rear side end of the rotation axis of the cleaning roller so that the rear side end is moved in an axial direction to be detached from the rear side supporting means and which biases the rear side end toward the heating roller.

2. A fixing device according to claim 1, wherein the front side supporting means is made detachable from an opposite side of the heating roller with respect to the rotation axis of the cleaning roller, rotatably supports the rotation axis, and includes a supporting chip which projects beyond the front frame and a spring which biases the supporting chip toward the heating roller.

3. A fixing device according to claim 1, wherein the rear side supporting means includes a bearing which supports the rear side end of the rotation axis of the cleaning roller so that the rear side end is moved in an axial direction so as to be detached from the bearing; a notch which is provided in the rear frame of a fixing device so that the bearing is slidably supported toward the heating roller; and a spring which biases the bearing in the notch toward the heating roller with the same biasing force of that of the front side supporting means.

* * * * *